US010442208B2

(12) United States Patent
Dabon et al.

(10) Patent No.: US 10,442,208 B2
(45) Date of Patent: Oct. 15, 2019

(54) COLORANT THROUGHPUT SYNCHRONIZER IN A PRINTER

(71) Applicant: KYOCERA Document Solutions Inc., Osaka (JP)

(72) Inventors: Philip Ver Paloma Dabon, Torrance, CA (US); Neil-Paul Payoyo Bermundo, Glendora, CA (US); Kendrick Esperanza Wong, Torrance, CA (US); Jesus Reyes Beltran, Los Angeles, CA (US)

(73) Assignee: Kyocera Document Solutions Inc., Osaka (JP)

( * ) Notice: Subject to any disclaimer, the term of this patent is extended or adjusted under 35 U.S.C. 154(b) by 14 days.

(21) Appl. No.: 15/634,757

(22) Filed: Jun. 27, 2017

(65) Prior Publication Data

US 2018/0370244 A1 Dec. 27, 2018

(51) Int. Cl.

| | |
|---|---|
| ***B41J 2/175*** | (2006.01) |
| ***B41J 2/44*** | (2006.01) |
| *B41J 2/21* | (2006.01) |

(52) U.S. Cl.

CPC ..... *B41J 2/17566* (2013.01); *B41J 2/442* (2013.01); *B41J 2/21* (2013.01); *B41J 2002/17589* (2013.01)

(58) Field of Classification Search

CPC ..... B41J 2/17566; B41J 2/442; B41J 2002/17589; B41J 2/21

See application file for complete search history.

(56) References Cited

U.S. PATENT DOCUMENTS

| | | | | |
|---|---|---|---|---|
| 10,126,680 | B1 * | 11/2018 | Dabon | H04N 1/00023 |
| 2016/0223930 | A1 * | 8/2016 | Harada | G03G 15/01 |

* cited by examiner

*Primary Examiner* — Henok D Legesse

(74) *Attorney, Agent, or Firm* — D'Ambrosio & Menon, PLLC; Usha Menon

(57) ABSTRACT

A method for synchronizing consumption of a plurality of toners in a printing device by implementing an automated toner Throughput rate reduction is disclosed, comprising steps of detecting levels of the plurality of toners; identifying, based on a given criteria and detected levels, at least one toner out of the plurality of toners that is running low; calculating a Throughput Rate Reduction (TRR) for each of the identified toners; and reducing Toner Throughput Rate (TTR) at the current printing mode for the identified toner by TRR thereby conserving the identified at least one toner. The toners are identified for reduced throughput based on a dynamic threshold that is equal to difference in its level as compared to toner having highest level. Dynamic thresholds for toners is determined either dynamically at beginning of each print job, or periodically at set intervals, or in combination of two.

12 Claims, 6 Drawing Sheets

COLORANT THROUGHPUT SYNCHRONIZER IN A PRINTER

FIELD OF DISCLOSURE

The present disclosure relates generally to the field of printing devices. In particular, the present disclosure pertains to a system and method to control toner(s) usage in a Multi-Functional Printer (MFP) depending on their current level with an aim to synchronize their consumption.

BACKGROUND

With advent of desktop computing during latter half of last century, printers have become ubiquitous as they provide means to transfer graphics or text generated or stored in digital form in the computing devices to a persistent human-readable representation on paper or similar physical media. Even though rapid penetration of internet during the current century has considerably reduced the need for printing as a means of moving documents, and simultaneous availability of wide variety of reliable digital storage systems has reduced need of a printed physical backup or printed offline reading material, printers are still required for special purposes, like printing photographs or artwork or legal and other documents which need to be presented in hard copies, and therefore, are essential equipment for any office. Continuously downward trend in cost of printers has made them affordable to be commonplace even for home applications for use as personal printers. As things stand today, conventional printers have been largely replaced by Multi-Functional Printers (MFPs) that are typically utilized for meeting scanning, printing, and copying needs of big and small entities or individuals.

MFPs typically print images by depositing toner (stocked in the printer in cartridges) on receivers (or imaging substrates), such as paper or other planar media, glass, fabric, metal, or other objects. They operate using toners of different colors such as cyan (C), magenta (M), yellow (Y), black (K), and other colorants. Events of any of these cartridges/toners getting exhausted are major reasons for interruption in working of MFPs as the printer stops giving prints of satisfactory quality. The printer may also be programmed to stop functioning as soon as any of the cartridges is exhausted. Therefore, economical consumption of toners can lead to fewer interruptions besides reducing printing cost on account of cost of cartridges.

As is evident, different documents/images require differing amounts of different toners depending on their composition leading to uneven usage of different toners. The un-even usage or varying rate of toner throughput causes some cartridges to run out faster than others, which leads to unplanned unavailability of printer or MFP equipment due to unavailability of certain toners. This also leads to frequent changing of cartridges for example next cartridge may need to be replaced in a relatively short amount of time after a previous one had just been replaced.

Therefore, MFPs remain down for undesirably long time due to running out of one or other toner sometimes merely for a single toner. Putting more technically, this problem arises on account of unequal throughput rates, which is amount of toner or ink being used/spent from each toner cartridge, for different toners during printing process. At a more micro-level, it is Toner Throughput Rate (TTR) that is manipulated or adjusted whenever a user actuates any of the provided modes (as illustrated by FIGS. 1, 2, and 3) of operation in conventional printers, albeit without linking the TTR to present level of respective toner in the cartridge.

There is therefore a need in the art for a MFP that overcomes above stated deficiencies of conventional MFPs.

SUMMARY

Aspects of the present disclosure relate to a printing device incorporating a Colorant Throughput Synchronizer for synchronizing consumption of a plurality of colorants in the printing device by applying an automated colorant throughput rate reduction on colorants that are identified to be running low. The Colorant Throughput Synchronizer detects levels of the plurality of colorants and based on detected levels, identifies colorants that are running low. The Colorant Throughput Synchronizer further calculates a Throughput Rate Reduction for each of the identified colorants that are running low and implements a reduced throughput rate for each of the identified colorants by reducing Colorant Throughput Rate at the current printing mode for the identified colorants by the calculated Throughput Rate Reduction thereby conserving the identified colorants.

The present disclosure further provides a method for synchronizing consumption of a plurality of colorants in a printing device. The disclosed method comprises steps of: (i) detecting levels of the plurality of colorants; (ii) identifying, based on detected levels and following a given criteria, at least one colorant that is running low; (iii) calculating a Throughput Rate Reduction for each of the identified colorants; and (iv) implementing a reduced Throughput Rate for each of the identified colorants, wherein Throughput Rate at the current printing mode for the identified colorants gets reduced by the Throughput Rate Reduction thereby conserving the identified at least one colorant.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DETAILED DESCRIPTION

Figure 1:
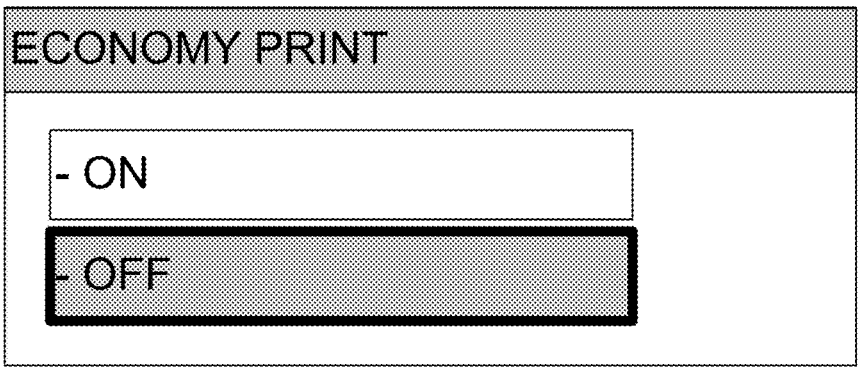
FIG. 1 (Prior Art)
FIG. 1 illustrates a display pertaining to economy print mode option that is provided in the related art.

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the present disclosure as defined by the appended claims.

Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims.

Various terms are used herein. To the extent a term used in a claim is not defined below, it should be given the broadest definition persons in the pertinent art have given that term as reflected in printed publications and issued patents at the time of filing.

"Colorant" as used in the present disclosure refer to media used in a printing device to generate on surface of a substrate such as paper, an image that the printing device is required to print during printing of print, scanned, copy or fax jobs and other such applications; and includes toners and inks and their cartridges for both laser or inkjet printers or other types of inking technology for the purpose of rendering images or content on a substrate such as paper. It is to be appreciated that terms "Colorant", "Toner" and "Ink" have been used interchangeably in the present disclosure without any limitation. And likewise, terms "Colorant cartridge", "Toner cartridge", "Ink cartridge" and "cartridge" have been used interchangeably.

"Draft mode" in context of current MFPs or printers, "draft mode" referred to in this disclosure includes draft mode and similar toner-saving features, such as fast draft mode or EcoPrint.

"Throughput Rate" or "Toner Throughput Rate" (TTR) refers to amount of colorant or toner or ink material that are produced or emitted from each colorant or toner or ink cartridge (or simply cartridge) during printing. This can also be thought of as the rate of colorant or toner or ink from each cartridge that gets put onto paper during printing. In normal printing mode, the toner throughput may be thought to be 90%. In high quality, it may 100%. In draft mode, it may be 65% or some other value depending on how it's set at the factory or defined during print head or printer engine design.

"Throughput Rate Reduction" (TRR) refers to reduction that will be applied to Throughput Rate applicable at the current printing mode to reduce the normal colorant throughput rate for cartridges. The resultant rate is "Reduced Throughput Rate" or "Reduced Toner Throughput Rate". To illustrate, for example, in normal printing mode, we said above that the "Toner Throughput Rate is 90%. When reducing this throughput by 10% to effectively save the colorant material from getting output or used for printing, the "Throughput Rate Reduction" (TRR) shall be 10% and the "Reduced. Throughput Rate" shall be 80%. In draft mode, where "Toner Throughput Rate" (TTR) would normally be 65% for example, the "Reduced Throughput Rate" would become 55%.

Embodiments explained herein relate to a printing device such as a printer or a Multi-Functional Printer (MFP) that incorporates features to synchronize consumption of different colorants (or toners or ink and these terms are used interchangeably hereinafter) so that respective cartridges (or toner cartridges or ink cartridges, and these terms used interchangeably hereinafter) get exhausted at more or less same time, simultaneously extending usable life of installed cartridges in the printer/MFP.

MFPs provide various modes for economizing toner consumption. For example, they provide a draft or/and a fast draft modes allowing a user to print documents using less toner ink or/and in lesser time than normal. Though documents printed in draft mode don't look as clean or as crisp as regular documents, they are satisfactory as test versions to allow the user to see what the print job would look like before printing the final copy, or for quickly printing out versions of his documents using less toner as he refines them. The draft/fast draft modes typically apply a uniform reduction on flow of all toner cartridges, and not on individual toner cartridges. For example, there is no indication that the draft mode applies to just the cyan toner cartridges and not to the other colors (magenta, yellow, and black cartridges).

Figure 2:
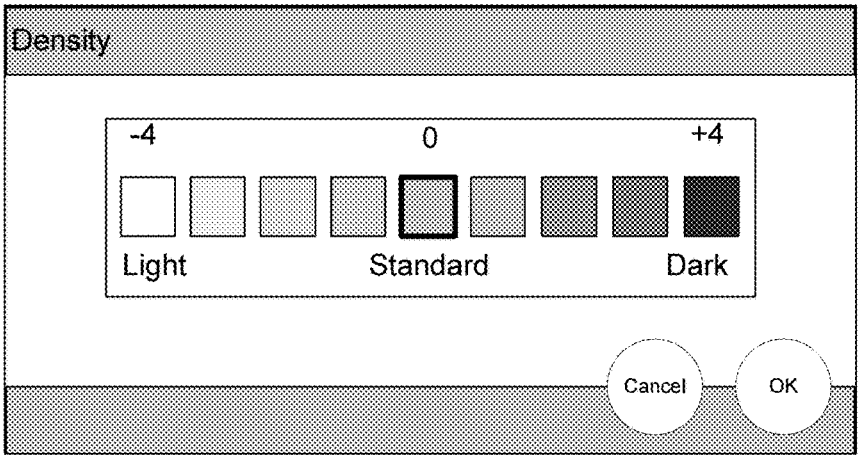
FIG. 2 (Prior Art)
FIG. 2 illustrates a display pertaining to default options to control density of toner that is provided in the related art.
Figure 3:
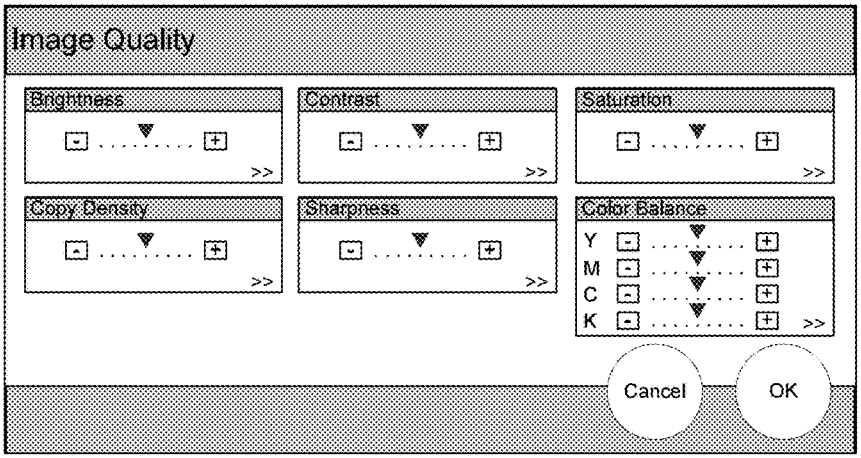
FIG. 3 (Prior Art)
FIG. 3 illustrates a display pertaining to additional print quality controls that is provided in the related art.

An example of modes for economizing toner consumption as well as exercising controls to influence print quality in the related art is economy mode as exemplified by FIG. 1. Another mode/control is one that enables a user to exercise his option among factory-set defaults to control density of toner for printouts as shown in FIG. 2. Yet another control/mode provided to enable a user to exercise his options in respect of features such as brightness, contrast color balance etc. among other features is shown in FIG. 3. However, none of these controls/modes control toner consumption on the basis of existing level of toners and thus do not provide a solution to problem of frequent changing of cartridges on account of unequal consumption of different toners/cartridges.

The disclosure addresses problem of frequent unavailability of printer/MFP due to frequent changing of cartridges one after the other as some colorant/toners get consumed faster than others that is encountered in printers. In an aspect, the present disclosure provides a Colorant Throughput Synchronizer (hereinafter referred to as Toner Throughput Synchronizer in the present disclosure) feature that when incorporated in conventional printing device such as a printer or MFP can result in synchronized consumption of different colorants/toners in the printer/MFP. The Toner Throughput Synchronizer (TTS) determines the levels of each toner cartridge (also referred simply as cartridge or simply as toner and all these terms used interchangeably hereinafter) and following a given criteria dynamically adjusts, synchronizes or schedules throughput of each of the toner cartridges. Further, the disclosed MFP gives control to user to select less frequently used cartridges for monochrome printing mode so that they will be used up more rather than those cartridges that are already running low on content.

In an aspect, the disclosure provides a method for synchronized usage of different toners as implemented by TTS.

In accordance with the disclosed method, synchronized usage of different toners can be achieved by monitoring rate of usage of each of toner cartridges, and applying algorithms to delay or modify throughput of toner material that is running low i.e. being consumed faster than others. This can allow usage of such toner cartridges to be slowed down or reduced, thereby allowing rest of the toner cartridges to catch up in usage.

In an aspect, the disclosed method can be implemented by applying automated toner throughput rate reduction on any one or combination of toners. Usage and remaining level of toner supply in each cartridge or tank is monitored, and if consumption of toner in one or more cartridges as compared to at least one cartridge is more than a set threshold value, the one or more cartridges can be selected for reduction of Throughput Rate (hereinafter referred to as Toner Throughput Rate).

In one embodiment, only the cartridge having the lowest level can be selected for reduction of Toner Throughput Rate (TTR) depending on a dynamic threshold of the cartridge being more than a set threshold value. In an alternate embodiment, more than one cartridge can be selected for TTR reduction depending their dynamic thresholds being more than the set threshold value; and the number of cartridges under TTR reduction can dynamically change to a single cartridge as some of them catch up with remaining resulting in their dynamic threshold becoming less than the set threshold value.

In an embodiment, dynamic threshold of the toners/cartridges can be gap or difference between levels of different toners/cartridges. For example, the dynamic threshold of a toner can be equal to difference in its level as compared to toner having next higher level or to toner having highest level. In a preferred embodiment dynamic threshold of a toner is taken to be equal to difference in its level as compared to toner having highest level.

In an aspect, identification of the cartridge(s) that qualify for TTR reduction can be done dynamically, wherein the levels and accordingly gaps/differences in levels, can be ascertained at beginning of each print job. Alternatively it can be done periodically at predefined intervals and the intervals, for example, can be defined by level of toner in cartridges. For example determination of gap between levels of different cartridges can be done whenever quantity of toner in cartridge having lowest level crosses a periodic threshold level—say 95%, 90%, 85% . . . and so on, and TTR reduction implemented if any of the cartridges qualify for the same. In an embodiment, the periodic threshold level can be factory set or user defined.

In an alternate embodiment, the gap between levels of different cartridges for identifying the cartridge(s) that qualify for TTR reduction can be done by a combination of periodic determination and dynamic determination, wherein periodic determination can be done in case of new printer engines or when new toner cartridges are installed on the printers, and after several print jobs, when level in at least one toner cartridge has fallen down to a set level, for example 40% quantity level, then the dynamic determination can take over.

In an aspect, the disclosure provides method for calculating TTR reduction after the cartridges that qualify for same have been identified. In an embodiment, a Throughput Rate Reduction (TRR) is calculated for implementing Toner Throughput Rate Reduction on the identified cartridges. The TRR is calculated in such a way that it can lead to conservation of toner material and extending of usability of such toner cartridge. In an embodiment, the TRR can be calculated based on gaps/difference in the toner level in different cartridges, wherein the reduction in the throughput rate is proportional to the gap in level of toner between the identified cartridge and the cartridge having maximum toner. For example, if toner in the identified cartridge is 10% less than another toner cartridge, then its TRR shall be 10%. Thus, it can output 10% lesser toner material compared to its normal toner throughput rate at the current printing mode.

In an aspect, effect of reduced toner throughput rate on print quality can be controlled by selecting a low set threshold value for example 1% or 3%, such that TTR reduction gets implemented when difference in toner level and accordingly difference in throughput rates, is not very large and therefore print quality impact is barely noticeable.

In an alternate method for Throughput Rate Reduction (TRR) calculation, the TRR is calculated by factoring expected number of sheets that the toner cartridge with lowest quantity level can still print and hence termed as Predictive Formula Method. The Predictive Formula Method tries to predict availability of toner material when such number of sheets is eventually printed from current point in time up to some point in time in the future. The Predictive Formula Method comprises steps of (a) identifying the toner cartridge with the highest quantity level; (b) calculating gap in toner level for the other toner cartridges with lesser quantity level (i.e., below the highest quantity level); (c) determining toner cartridge with lowest quantity level; (d) setting a goal level based on quantity level of toner cartridge having lowest quantity level, wherein the goal level is lower than the lowest quantity level to ensure that in subsequent printing, this toner cartridge will still contribute to the print in high quality or normal quality modes (for example, if the lowest toner cartridge is at 30% quantity level, the goal level can be set to 25% quantity level); (e) determining expected number of sheets based on the identified goal level for the toner cartridge with lowest quantity level, wherein this can be based on data from printer manufacturer or from the printing experience or printing history in the workplace or customer's location; (f) calculating, for each of the toner cartridges that are selected for TTR reduction, an effective TRR using the formula: toner gap in the cartridge/(Expected Number of Sheets at Goal Level); and (g) applying the respective calculated TRR to each toner cartridge.

In an aspect, the disclosure provides for selection of a specific toner or color for monochrome printing mode as means to extend usable life of all installed toner cartridges or ensuring that different toners get exhausted at more or less same time. For this, toner cartridge that has most quantity can be selected for monochrome printing when other toners have reached certain low level quantity. The level of toner in different cartridges can be monitored and based on gap in level of different cartridges, the toner cartridge having highest level can be automatically selected for use as the designated toner for monochrome printing, hoping to help extend or prolong the usability of the toner cartridges that are running low in quantity or level of material.

In an embodiment, selection of a specific toner or color for monochrome printing mode can be user selectable, wherein user can opt for any of the plurality of toner or color to be used for printing in monochrome mode based on level of different cartridges.

In an aspect, the present disclosure provides a printing device that includes: a Toner Throughput Synchronizer (TTS) that can be configured to detect level of a plurality of toner cartridges, and identify, based on a dynamic threshold, at least one toner cartridge out of the plurality of toner cartridges for automatically and dynamically implementing a Toner Throughput Rate reduction, and calculate a Toner Throughput Reduction based on a given algorithm.

In an aspect, dynamic threshold which the TTS uses to identify at least one toner cartridge out of the plurality of toner cartridges for implementing a Toner Throughput Rate reduction can be difference/gap in level of different cartridges, and the TRR for a particular toner cartridge can be equal to difference in level of the particular toner cartridge and highest toner level of the plurality of toner cartridges. Alternatively, TRR for a particular toner cartridge can be calculated by a predictive method, wherein the TRR for different cartridges is calculated based on expected number of sheets, N, that can be printed using toner quantity equal to a goal level, wherein goal level is selected such that it is less than or equal to lowest level of the plurality of toner cartridges, and wherein the TRR is equal to the gap in level of the particular cartridge divided by the expected number of sheets, N.

Figure 4:
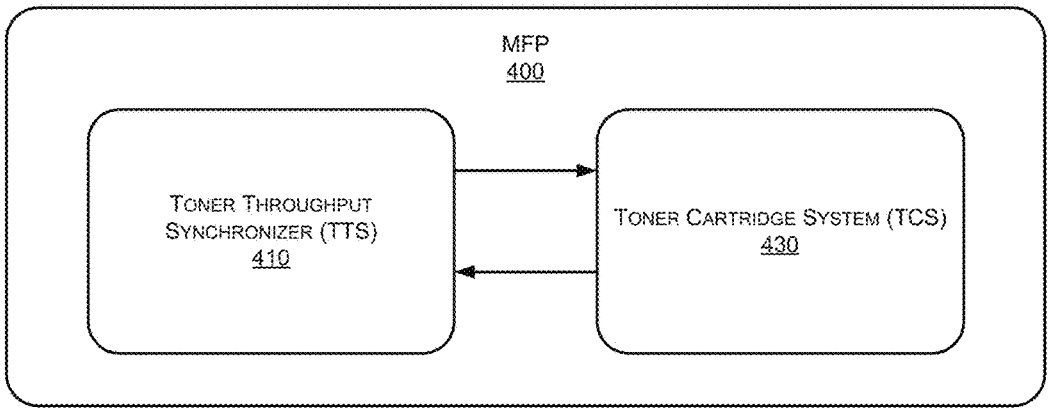
FIG. 4 illustrates an exemplary block diagram indicating interaction of toner throughput synchronizer (TTS) with other systems for synchronized toner throughput in accordance with embodiments of the present disclosure.

FIG. 4 illustrates an exemplary block diagram indicating interaction of toner throughput synchronizer (TTS) with other systems for synchronized toner throughput in accordance with embodiments of the present disclosure. As shown, the TTS 410 interacts with Toner cartridge system 430 of the printer 400. The Toner Cartridge System 430 can be block of hardware components that manage or handle the retrieval or extraction of toner or ink for use in printing. The TTS 410 can be configured to detect level of a plurality of toner cartridges, and identify based on a given criteria, at least one toner cartridge of the plurality of toner cartridges that qualify for Toner Throughput Rate reduction and thereafter calculate, following a given algorithm, a reduced Toner Throughput Rate for the identified cartridges which can be implemented through the Toner cartridge system 430.

In an embodiment, criteria for identifying one or more cartridges for implementing TTR reduction can be based on gap or difference in level of toner in different cartridges. For example, in one embodiment, the cartridge having the lowest level can be selected (therefore referred to as singular toner cartridge synchronization) for TTR reduction depending on gap in its level as compared to next lowest cartridge such that when difference in levels of cartridges having lowest level and next higher level becomes more than a set threshold value the cartridge having lowest level can be identified for TTR reduction.

In an alternate exemplary embodiment, more than one cartridge can be selected for TTR reduction depending on gap in their level as compared to cartridge having highest level (therefore referred to as multiple toner cartridge synchronization). For example when difference in levels of certain cartridges with the cartridge having highest level becomes more than the set threshold value, they can be selected for TTR reduction. For example, if Cyan toner cartridge and Magenta toner cartridge have fallen to a level that is 10% and 5% lower compared to both Yellow and Black toner cartridges (which may both have in same level just for example) against a set threshold value of say 3%, the toner throughput for Cyan and Magenta toner cartridges will be adjusted or reduced so that they do not get used more. The toner throughput rate for Cyan cartridge may be reduced by 8% while the Magenta cartridge may be reduced by 5%. They would output less than what they would have normally outputted at the current printing mode.

In an embodiment, there can be combination of singular toner cartridge synchronization and multiple toner cartridge synchronization in which the multiple cartridges can be taken up for TTR reduction but their number can dynamically change to a single cartridge as some of them catch up with remaining resulting in gap in their level as compared to cartridge having highest level becoming less than the set threshold value.

For example, if Cyan toner cartridge and Magenta toner cartridge have fallen to a level that is 10% and 5% lower compared to both Yellow and Black toner cartridges (which may both have in same level just for example) against a set threshold value of say 3%, the toner throughput for Cyan and Magenta toner cartridges will be adjusted or reduced so that they are used less. The toner throughput rate for Cyan cartridge may be reduced by 8% while the Magenta cartridge may be reduced by 5%. They would output less than what they would have normally outputted at the current printing mode. Therefore at some point during printing, it may happen that one toner cartridge, say, the Magenta toner cartridge due to reduced TTR catches up with Yellow and Black whereas the Cyan cartridge is still at a level 10% below level others. Under such scenario singular toner cartridge synchronization can take over as only the Cyan cartridge shall qualify for TTR reduction.

In an aspect, TTS 410 can be configured to automatically identify toner cartridge(s) that qualify for Toner Throughput Rate reduction and thereafter calculate and implement a reduced Toner Throughput Rate (referred to as Automated Toner Throughput Rate Reduction), wherein user can exercise control to select which type to apply, whether singular toner cartridge synchronization, multiple toner cartridges synchronization or combination of the two as described above.

As can be appreciated, when multiple or variable number of toner cartridges are monitored and managed for Automated Toner Throughput Rate Reduction, it is possible to achieve uniform usage for all toner cartridges while maintaining optimal level of print quality or reduced adverse impact on print quality. Eventually, all toner cartridges will have almost same quantity levels because whenever one or two falls a minimal threshold level, their toner throughput will be reduced and managed. Thus, their quantity will be conserved and their usage extended, until such point those other toner cartridges with higher quantity level fall to the same quantity level as the managed toner cartridges.

In an embodiment, due to reduction in toner agent/material from one or more color(s) toner cartridge(s), there would be a very small impact on the print quality for the corresponding color(s). For example, if the images in a page require a substantial amount of Cyan, but Cyan is running low in supply, Cyan toner throughput rate would be the one reduced, and there will be less of Cyan output as compared to its normal throughput rate at the current printing mode. In practice, impact on quality of print can be minimized by selecting a low value for set threshold value say 2% or 3% so that Automated Toner Throughput Rate Reduction gets implemented with a low reduction in throughput of the effected toner as would be evident from subsequent description of calculation of Toner Throughput Rate Reduction.

In an embodiment, set threshold value can be factory set, and as stated earlier may be a low figure such as 1% or 3% so that printing quality impact is minimal. In an alternate implementation it is possible to have different user selectable options as under through a user interface:

| | | |
|---|---|---|
| ____ | 1% | threshold |
| ✓ | 3% | threshold (default) |
| ____ | 5% | threshold |

In yet another implementation, it is possible to provide for a user defined set threshold value through user interface as under where user can himself enter a set threshold value and implement the same:

| | | |
|---|---|---|
| ____ | 1% | threshold |
| ✓ | 3% | threshold (default) |
| ____ | 5% | threshold |
| ____ | ____ | user defined threshold |

However, in view of user inexperience it may be advisable to have a factory set low threshold value in interest of print quality and efficient synchronization of toner consumption.

In an embodiment, TTS 410 can be configured such that the Automated Toner Throughput Rate Reduction can be applied in any of the available printing modes, whether fast draft mode, draft mode, normal or high quality prints. A user interface can allow for selection of printing modes in which the Automated Toner Throughput Rate Reduction will be applied. For example, interface can allow for applying the Automated Toner Throughput Rate Reduction at all the times regardless of the printing mode or allow for selecting one or modes such as fast draft mode, draft mode, normal or high quality prints or any other printing mode for applying the Automated Toner Throughput Rate Reduction.

In practice, when Automated Throughput Rate Reduction is applied in normal or high quality mode, actual print quality may have lower quality than when this is feature is OFF, due to the dynamic reduction of toner throughput rate on toner cartridges that are running low. And therefore, the disclosed feature is most suited for fast draft mode, draft mode and monochrome modes, as the print outs in these modes are expected to be less than ideal quality. However, depending on user preference, this feature can be enabled even for normal and high quality printing modes if it is desired that the toner throughput for all toner cartridges would be synchronized so that they become empty almost at the same time.

In an embodiment, TTS 410 can be configured to dynamically determine gap/difference in levels/dynamic threshold of different cartridges for identifying the cartridge(s) that qualify for TTR reduction. In order to prevent variation of print quality during a print job due to TTR reduction, the exercise of determining the gap can be done at beginning of each print job. Alternatively it can be done periodically at predefined intervals. In one implementation, the interval can be defined by level of toner in cartridges. For example determination of gap between levels of different cartridges can be done whenever quantity of toner in cartridge having lowest level crosses a periodic threshold level—say 95%, 90%, 85% . . . and so on. In an embodiment, the periodic threshold level can be factory set or user defined.

In an alternate embodiment, the gap between levels/dynamic threshold of different cartridges for identifying the cartridge(s) that qualify for TTR reduction can be done by a combination of periodic determination and dynamic determination, wherein periodic determination can be done in case of new printer engines or when new toner cartridges are installed on the printers, and after several print jobs, when level in at least one toner cartridge has fallen down to a set level, for example 40% quantity level, then the dynamic determination can take over.

In an embodiment, the disclosed TTS 410 can incorporate features to enable a user/administrator to select (using an interface similar to or other than that being presented in the present disclosure) any of singular/multiple/combination toner cartridges synchronization, as discussed hereinbefore, for desired Throughput Rate Reduction (TRR). Another control or configuration that can be provided is to allow the user or administrator to select modes of printing in which automated toner throughput rate reduction is activated. In an embodiment, change(s) are applied only at the start of print jobs. By default, any change will not be applied in the middle of the print jobs to allow for consistent toner quality for all pages in instant print job. Preferably, a control or configuration can be provided so that user or administrator can choose to apply this adjustment for each page in a print job.

In an aspect, the present disclosure provides method for calculating Throughput Rate Reduction (TRR) that can be implemented Automated Toner Throughput Rate Reduction on the identified cartridges. The TRR is calculated in such a way that it can lead to conservation of toner material and extends usability of such toner cartridge so that they catch up with other cartridges that have higher level at some point in time. It may not guarantee that all toner cartridges would become empty at the same time, or that they would be at the same level at some point in time, as that would depend on actual toner requirements of future print jobs, which may require use of one particular toner most of the time, such us Black toner cartridge or always Cyan toner. When such imbalance occurs in the usage of toners, the system would be able to extend the usability of both or either Black and/or Cyan toner cartridges, but those colors would still run out faster than the Magenta and Yellow toner cartridges.

However, with the present Toner Throughput Synchronizer feature, it would be possible to reduce the toner throughput rate for the Black and/or Cyan as they fall below threshold levels, and thus, ensure that they will be conserved and their usability extended. For such use cases where the Black and/or Cyan are used frequently in print jobs, the disclosed feature would help ensure that more of such print jobs will be printed as against numbers printed without this feature.

In one embodiment, the TRR can be calculated based on gaps in toner level in different cartridges, wherein the reduction in the throughput rate is proportional to the gap in level of toner between the identified cartridge and the cartridge having maximum toner. For example, if toner in the identified cartridge is 10% less than the other toner cartridge, then its TRR shall be 10%. Thus, it can output 10% lesser toner material compared to its normal toner throughput rate at the current printing mode. For example, if current toner levels are: Cyan 80%, Magenta 90%, Yellow: 30% and Black 50%, toner cartridge identified with highest toner level shall be Magenta that is at 90% level. In next step gap/difference in level/dynamic threshold of other cartridges shall be calculated by subtracting their level from the highest toner level i.e. 90%; such as Cyan: 10% (90%–80%), Yellow: 60% (90%–30%) and Black: 40% (90%–50%) Based on the calculated gap/difference in level/dynamic threshold of other cartridges the Toner Throughput Rate shall be reduced 10%, 60% and 40% for Cyan, Yellow and Black respectively (presuming that the set threshold value is less than 10% and therefore all of them qualify for TTR reduction). Accordingly, toner in the Cyan toner cartridge will be conserved by 10%. Toner throughput for Magenta toner cartridge will continue at its prescribed rate at the current printing mode. Toner throughput for Yellow toner cartridge will be reduced by 60% and throughput for Black toner cartridge will be reduced by 40% as compared to their normal throughput rate for current printing mode.

It is to be appreciated that above example is a bad case scenario where Yellow toner cartridge has fallen down as much as 30% quantity that is too far below the Magenta toner cartridge, which is at 90% quantity level. Under such conditions, the pages that require more Yellow toner would get less Yellow toner. In effect, the Yellow tint or effect will be much lighter because it would be reduced by 60% than what it would have been without Reduced Toner Throughput Rate. In actual implementations, the Toner Throughput Synchronizer feature shall be turned ON most, if not, all the time and therefore, all toner cartridges would be monitored and managed, and the toner throughput of each will be adjusted whenever they fall below a certain level i.e. the threshold level that is in effect. Thereby those toner cartridges that are lesser in quantity levels would be conserved not allowing their level to go down so drastically.

For example, if the set threshold value is set to say 1% or 3% or some such low figure, no toner cartridge will fall lower than 1% or 3% or some low percentage value compared to the toner cartridge with highest quantity level. Under such conditions, effect of reduced toner material used during printing on the Print Quality would be barely noticeable. Potentially, print quality of printouts may even be acceptable in high quality printing modes, and not just in draft or normal printing modes. Thus effect of reduced toner throughput rate on print quality can be controlled by selecting a low set threshold value for example 2% or 3%, such that TTR reduction gets implemented when difference in toner level and accordingly difference in throughput rates, is not very large and therefore print quality impact is barely noticeable.

In an alternate method for TRR calculation, the TRR can be calculated by factoring expected number of sheets that the toner cartridge with lowest quantity level can still print and hence termed as Predictive Formula Method. The Predictive Formula Method tries to predict availability of toner material when such number of sheets is eventually printed from current point in time up to some point in time in the future. The Predictive Formula Method comprises steps of (a) identifying the toner cartridge with the highest quantity level; (b) calculating gap in toner level for the other toner cartridges with lesser quantity level (i.e., below the highest quantity level); (c) determining toner cartridge with lowest quantity level; (d) setting a goal level based on quantity level of toner cartridge having lowest quantity level, wherein the goal level is lower than the lowest quantity level to ensure that in subsequent printing, this toner cartridge will still contribute to the print out quality (for example, if the lowest toner cartridge is at 30% quantity level, the goal level can be set to 25% quantity level); (e) determining expected number of sheets based on the identified goal level for the toner cartridge with lowest quantity level, wherein this can be based on data from printer manufacturer or from the printing experience or printing history in the workplace or customer's location; (f) calculating, for each of the toner cartridges that are selected for TTR reduction, an effective TRR using the formula: toner gap in the cartridge/(Expected Number of Sheets at Goal Level); and (g) applying the respective calculated TRR to each toner cartridge.

For example, if current toner levels are: Cyan 80%, Magenta 90%, Yellow: 30% and Black 50%, toner cartridge identified with highest toner level shall be Magenta that is at 90% level. In next step gap/difference in level/dynamic threshold of other cartridges shall be calculated by subtracting their level from the highest toner level i.e. 90%; such as Cyan: 10% (90%−80%), Yellow: 60% (90%−30%) and Black: 40% (90%−50%). Also, toner cartridge having lowest level as Yellow toner cartridge having 30% level. Based on quantity level of toner cartridge having lowest quantity level i.e. 30% being the level of Yellow cartridge, a Goal Level of 25% (or some value below the 30% being level of Yellow that is in now) can be set. At next step, expected Number of Sheets for Yellow at 25% can be calculated. Assuming for example, that a brand new Yellow Toner cartridge is expected to print 1000 pages, then at 30%, it may be able to print 300 more pages. At Goal Level of 25%, this will be 250 more pages without fully using up the 30% toner material that is remaining for Yellow toner cartridge thus conserving some for future printing in normal or high quality mode. Based on this figure Throughput Rate Reduction for each selected toner cartridge can be calculated as under:

Cyan: 10/250=0.04 or 4%

Magenta: No change or 0%

Yellow: 60/250=0.24 or 24%

Black: 40/250=0.16 or 16%

Accordingly, Toner Throughput rates for Cyan, Yellow and Black would be reduced by 4%, 24% and 16% respectively as against what it would have been at the current printing mode, Magenta would not undergo any change.

It is to be appreciated that above example is a bad case scenario due to the Yellow toner cartridge being far below in quantity level compared to Magenta toner cartridge. In actual practice level of different toner cartridges shall not be too far apart. As can be appreciated, Predictive Formula Method applies reduction in Toner Throughput Rate on each toner cartridge in a fair manner, such that each toner cartridge will always have a chance to be conserved as its quantity level falls below the other toner cartridges. When its quantity level catches up with other toner cartridges, the feature would allow all toner cartridges to operate at their normal throughput rate. When any toner cartridge again falls below the other toner cartridge(s), Toner Throughput Synchronizer Feature would then again kick in and manage the toner throughput of all toner cartridges.

It is to be appreciated that while the present disclosure provides above two methods to calculate the reduction in Toner Throughput Rate, it is possible to develop and implement other formulas to meet the objectives of this invention and all such methods are well within the scope of the present disclosure without any limitation.

In an aspect, if there are several methods that the system can support to calculate and enforce Reduced Toner Throughput Rate, a configuration or control can be created so that user and/or administrators can influence how the system will conserve and extend the usability of the toner cartridges.

It is to be appreciated that the present disclosure is about conserving colorants in a manner that respective cartridges get exhausted almost at the same time. In the process, print quality may get impacted. Although, as stated earlier, it is possible to limit the impact of Toner Throughput Synchronizer 410 on the print quality by selecting a low set threshold value, there may be instances where consumption of a particular colorant may be consistently high resulting in its higher consumption compared to other colorants in spite of implementation of reduced TTR. For example, if print jobs are always using more of yellow, yellow colorant will get used up faster. Under such scenario, even if TTS is turned ON, over a period difference in level of yellow colorant as compared to highest level may become so high that application of Throughput Rate Reduction to reduce yellow could result in a different color such as more greenish color.

In an embodiment, TTS 410 can incorporate feature that based on a minimal regression of color or print quality warns user that reduction of Toner Throughput Rate cannot be performed due to color change. The warning system can be implemented through user interface and can include option for user to turn OFF the TTS feature or CONTINUE irrespective of print quality. In an implementation, it is possible that based on a minimal regression of color or print quality, TTS feature is turned OFF automatically without providing any option to the user.

In an implementation, it is possible that TTS is implemented only in certain modes such as in draft mode and/or fast draft mode. However, it may be appreciated that under such application depending on frequency of use of these modes, it may be difficult to achieve objective of the present disclosure, which is synchronizing consumption of a plurality of colorants.

In an aspect, the disclosure provides Automatically Designated Toner for Monochrome Mode for selection of a specific toner or color for monochrome printing mode as means to extend usable life of all installed toner cartridges or ensuring that different cartridges get exhausted at more or less same time. Automatically Designated Toner for Monochrome Mode can allow automatic selection of toner cartridge that has substantially high level/quantity when other toners have reached certain low level/quantity. In this mode, Toner Throughput Synchronizer (TTS) 410 can monitor level of toner in different cartridges and based on gap in level of different cartridges, and automatically select the toner cartridge having highest level for use as the designated toner for monochrome printing, hoping to help extend or prolong the usability of the toner cartridges that are running low in quantity or level of material.

In an embodiment, selection of a specific toner or color for monochrome printing mode can be user selectable, wherein user can opt for any of the plurality of toner or color to be used for printing in monochrome mode based on level of different cartridges. In the monochrome mode, as happens normally, Black cartridge would be used. With the instant option, the user can select and designate a different toner for use in the monochrome mode printing and thus prevent Black cartridge from running out faster than others.

Figure 5:
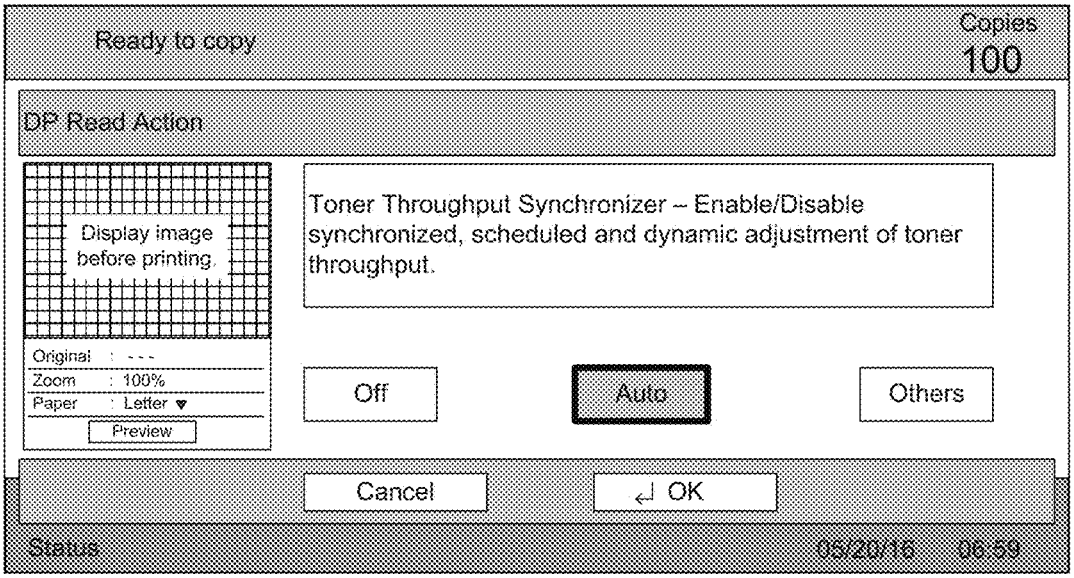
FIG. 5 illustrates exemplary screenshot of user interface showing main menu for Toner Throughput Synchronizer (TTS) in accordance with embodiments of the present disclosure.

FIG. 5 illustrates an exemplary screenshot showing main menu for user interface in respect of Toner Throughput Synchronizer feature of the printer in accordance with embodiments of the present disclosure. Printer or MFP front panel can be updated to show the exemplary main menu as an interface with the TTS feature and enable user to manage and control the toner throughput with the goal of prolonging life or usability of the toner cartridges.

In an embodiment, the main menu can include "Off", "Auto" and "Others" buttons. "Off" can be the default mode, wherein toner material goes through the print heads at their normal rate for the current print mode. "Off" button thus provides the normal, current behaviour of the printer without Toner Throughput Synchronizer feature coming in effect. In this mode, all toner cartridges run at normal throughput rates as required for whichever printing mode is active: draft, fast draft, normal, high quality, and others.

In an embodiment, clicking "Auto" can activate the TTS feature that implements Automated Toner Throughput Rate Reduction, wherein when a toner falls below a threshold level compared to other toner cartridges, its toner throughput rate would get adjusted and reduced. In this mode, regardless whether it is in multi-color or monochrome printing mode, the toner throughput rating for each toner cartridge will be set for the goal of synchronizing usage for all toners.

In an embodiment, clicking "Others" can provide access to advanced features of TTS by opening next screen of the interface.

Figure 6:
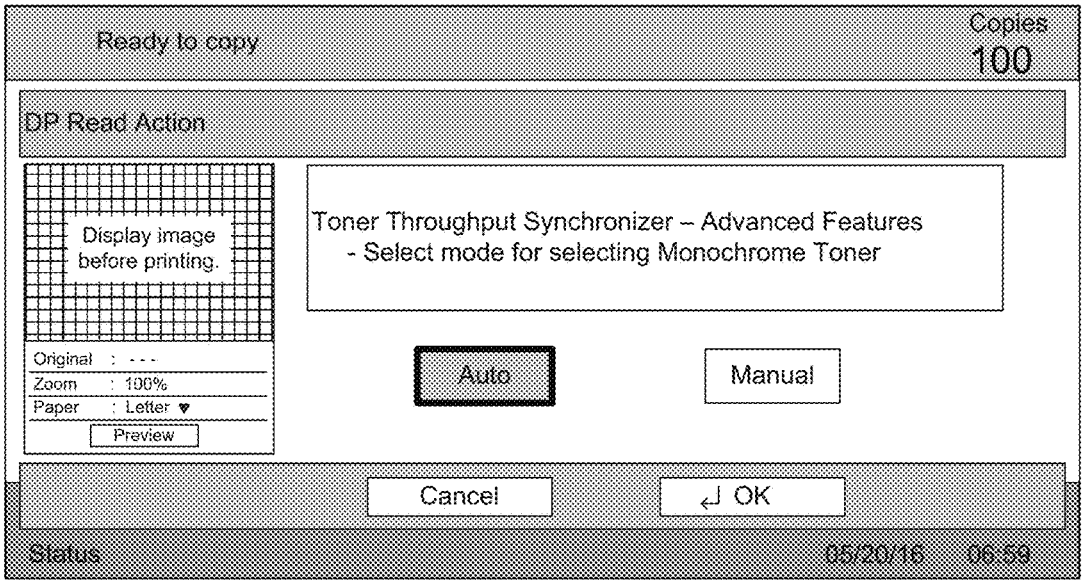
FIG. 6 illustrates an exemplary screenshot of user interface showing menu for enabling advanced features of TTS in accordance with embodiments of the present disclosure.

FIG. 6 illustrates an exemplary screenshot showing menu for enabling advanced features of TTS 410 in accordance with embodiments of the present disclosure. The advanced features pertain to monochrome printing and are User-Designated Monochrome Toner (Manual) and Automatic Monochrome Toner (Auto). The interface can provide two buttons i.e. "Auto" and "Manual" that provide mutually exclusive selection i.e. selecting one would unselects the other, Clicking on any of the two buttons can activate the respective advanced feature. While selecting "Auto" can activate Automatic Monochrome Toner selection, clicking "Manual" can open a third interface screen to enable user to select a toner for monochrome printing.

When "Auto" is selected automatic draft and monochrome toner mode gets activated in which, TTS performs analysis of toner levels and adjusts toner throughput as needed to achieve optimal usage of all toner cartridges, for the purpose of extending their usability. The TTS can automatically select the toner cartridge with the highest level to be the toner for use in monochrome prints. As level of auto-selected toner falls lower than other toners, the TTS will switch to another toner with the highest level of quantity. It will perform this auto-switching for as long as this mode is active. When all toner cartridges fall down to or reach same levels, the device 400 may switch to factory-default toner cartridge for Monochrome mode, which can be the Black toner cartridge.

In an embodiment, automatically selected monochrome toner will take effect for the entire print job so as to maintain consistency, and will not be changed in the middle of the print job. This is to ensure that all pages of the current print job are printed in similar color(s).

In User-Designated Monochrome Toner mode, a user can explicitly choose and fix the use of a toner cartridge for monochrome mode prints. Normally, monochrome prints will use the black toner. This has potential to use up the black toner faster than the other toner cartridges. This does not allow use of the other colours, even if they are still not empty. This option allows the designation of one color toner for use as monochrome toner, thereby not disabling the user from printing possibly urgent documents. Otherwise, printing may be stalled and hinder the user from printing important documents.

Figure 7:
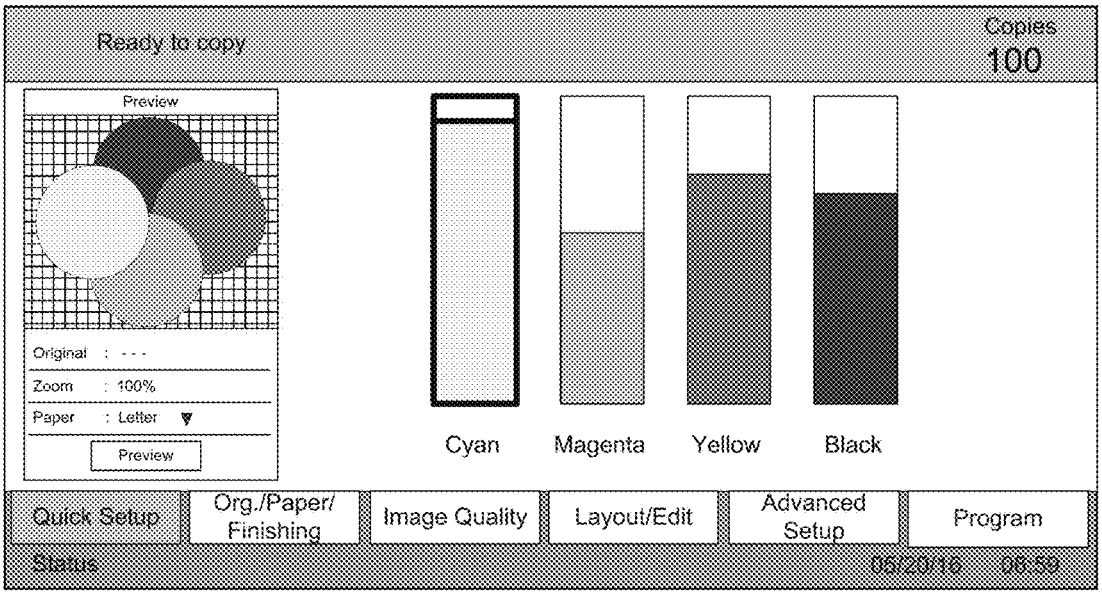
FIG. 7 illustrates an exemplary screenshot of user interface showing sub-menu for manual selection of monochrome toner in accordance with embodiments of the present disclosure.

FIG. 7 illustrates an exemplary screenshot showing user interface with sub-menu for manual selection of new monochrome toner in accordance with embodiments of the present disclosure. When a user selects this option, a sub-dialog user interface will be presented to the user to allow the quantity level of the current Monochrome toner and to know which other toner cartridges the user may opt to use subsequently as new designated toner for Monochrome mode. As shown in this example menu, Cyan (C) toner is highlighted as the designated toner cartridge to use for Monochrome mode printing. Because this is Manual mode, Cyan (C) would be the Monochrome toner that will be used until the user replaces it with another or until the printer is reset to factory defaults or other kind of reset command is performed on the printer.

Figure 8:
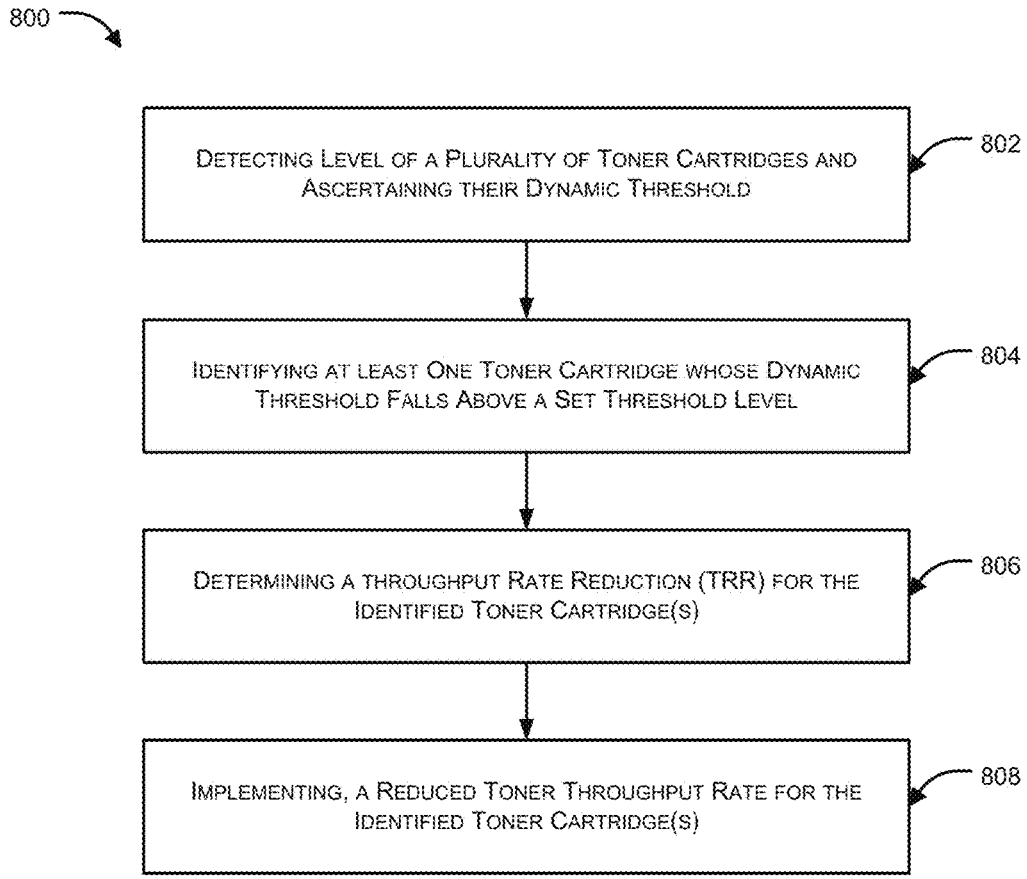
FIG. 8 illustrates an exemplary flow diagram the proposed method for synchronized toner throughput in accordance with an embodiment of the present disclosure.

FIG. 8 illustrates an exemplary flow diagram 800 showing method of Toner Throughput Synchronization in a printing device, such as printer 400, in accordance with embodiments of the present disclosure. The method 800 can include steps of detecting level of a plurality of toner cartridges installed in the printer at step 802, wherein detection of level can be done by a toner throughput synchronizer (TTS) 410 and the detected levels can be used to ascertain a dynamic threshold for the cartridges; identifying, at step 804, at least one toner cartridge out of the plurality of toner cartridges whose dynamic threshold that has fallen above a set threshold level; determining, at step 806. Throughput Rate Reduction (TRR) for the identified at least one toner cartridge, wherein the TRR can be calculated by the TTS 410 by applying at least one algorithm; and implementing at step 808, a reduced Toner Throughput Rate for the identified at least one toner cartridge, wherein implementation can be done by Toner Cartridge System (TCS) 430 of the printer 400 whereby Toner Throughput Rate at the current printing mode for the identified cartridges gets reduced by TRR thereby conserving toner from the effected cartridge.

In an embodiment, in order to prevent print quality going down to an unacceptable level, the method can further include a step of warning a user of inability to implement reduced Toner Throughput Rate. Decision about the inability to implement reduced Toner Throughput Rate can be taken based on a minimum regression of colorant or print quality. Further, the user can be provided an option either to turn OFF implementation of reduced Toner Throughput Rate for the identified at least one colorant, or continue irrespective of the print quality.

Thus the disclosed TTS synchronizer feature in a printing device and method of toner throughput synchronization of the present disclosure addresses problem of unplanned unavailability of printer or MFP due to unavailability of one toner, while others are still more than half full.

The present disclosure also addresses problem of frequent unavailability of printer or MFP due to frequent changing of cartridges as cartridges are changed one after another because some toners become faster than others, but the others would need to be changed after a few prints.

With Toner Throughput Synchronizer, changing the toner cartridges could be done almost at the same time, lessening the chance of unexpected, prolonged or frequent changing of toner cartridges. Printer outages could be anticipated, planned and scheduled better based on similar toner levels for all cartridges.

Especially in busy workplaces that print a lot of documents, this could be a welcome option. This can not only synchronize usage of toner cartridges so that they run out almost at the same time, but can also prolong life or usability of toner cartridges that are running low in content levels.

While the foregoing describes various embodiments of the invention, other and further embodiments of the invention may be devised without departing from the basic scope thereof. The scope of the invention is determined by the claims that follow. The invention is not limited to the described embodiments, versions or examples, which are included to enable a person having ordinary skill in the art to make and use the invention when combined with information and knowledge available to the person having ordinary skill in the art.

What is claimed is:

1. A method for synchronizing consumption of a plurality of colorants in a printing device, the method comprising steps of:

detecting levels of the plurality of colorants;

identifying, based on detected levels, at least one colorant out of the plurality of colorants that is running low, wherein the at least one colorant is identified following a given criteria;

calculating a throughput rate reduction for each of the identified at least one colorant, wherein the throughput rate reduction for the identified at least one colorant is calculated based on difference in level of the identified at least one colorant as compared to colorant having highest level; and implementing a reduced throughput rate for each of the identified at least one colorant, wherein throughput rate at the current printing mode for the identified at least one colorant gets reduced by the throughput rate reduction thereby conserving the identified at least one colorant.

2. The method as claimed in claim 1, wherein the identified at least one colorant is identified based on a dynamic threshold, wherein colorants whose dynamic threshold is above a set threshold value are identified.

3. The method as claimed in claim 2, wherein the dynamic threshold of the at least one colorant is equal to difference in levels of the at least one colorant as compared to other colorants.

4. The method as claimed in claim 3, wherein the dynamic threshold of the at least one colorant is equal to difference in level of the at least one colorant as compared to colorant having next higher level or to colorant having highest level.

5. The method as claimed in claim 3, wherein the dynamic thresholds for the plurality of colorants is determined by either dynamic determination at beginning of each print job or periodic determination at set intervals; or determined in combination of dynamic determination at beginning of each print job and periodic determination at set intervals.

6. The method as claimed in claim 5, wherein the set intervals for periodic determination of the dynamic thresholds is defined by level of at least one colorant out of the plurality of colorants, and preferably the set intervals is defined by level of colorant that is running lowest.

7. The method as claimed in claim 5, wherein the set intervals for periodic determination of the dynamic thresholds are factory set or user selectable.

8. The method as claimed in claim 5, wherein the dynamic thresholds for the plurality of colorants is determined by a combination of periodic determination and dynamic determination, wherein periodic determination is done in case of new printer engines or new colorant cartridges, and the dynamic determination takes over after level of at least one colorant has fallen below a set level.

9. The method as claimed in claim 1, wherein the throughput rate reduction for the identified at least one colorant is equal to the difference in level of the identified at least one colorant as compared to colorant having highest level.

10. The method as claimed in claim 1, wherein the throughput rate reduction for the identified at least one colorant is calculated by a predictive formula method, the predictive formula method comprising steps of:

(a) identifying colorant with the highest level;

(b) calculating difference in level of the identified at least one colorant as compared to level of colorant having the highest level;

(c) identifying colorant with lowest level and ascertaining level of the identified colorant with lowest level;

(d) setting a goal level based on level of colorant with lowest level, wherein the goal level is lower than or equal to level of colorant with lowest level;

(e) determining, based on data from printer manufacturer or from the printing experience or printing history in the workplace or customer's location, expected number of sheets from the goal level for the colorant having lowest level; and (f) calculating, for each of the identified at least one colorant, the throughput rate reduction using formula:

difference in level of the identified at least one colorant/(The expected Number of sheets from the goal level).

11. The method as claimed in claim 1, wherein the method comprises step of automatic selection of colorant that is running lowest in monochrome print mode, or enables user selection of colorant out of the plurality of colorants that is used in monochrome print mode.

12. The method as claimed in claim 1, wherein the method further comprises step of warning a user of inability to implement reduced throughput rate, wherein the inability to implement reduced throughput rate is assessed based on a minimum regression of colorant or print quality; and wherein the user is provided an option to turn OFF implementation of reduced throughput rate for each of the identified at least one colorant or continue irrespective of the print quality.

* * * * *